United States Patent [19]

Davenport

[11] 3,952,985

[45] Apr. 27, 1976

[54] CLIP FOR HANGING SIGNS

[75] Inventor: Joseph A. Davenport, Middleburg Heights, Ohio

[73] Assignee: Fastway Fasteners, Inc., Lorain, Ohio

[22] Filed: Nov. 25, 1974

[21] Appl. No.: 526,634

[52] U.S. Cl. ..... 248/317; 24/259 R

[51] Int. Cl.[2] ..... F21S 1/02; A44B 21/00

[58] Field of Search ..... 248/317, 228, 226 E, 248/72; 24/259 R, 259 TF, 201 S, 230 F

[56] References Cited

UNITED STATES PATENTS

| | | | |
|---|---|---|---|
| 656,274 | 8/1900 | Streeter | 248/228 UX |
| 2,438,085 | 3/1948 | Woodings et al. | 248/228 UX |
| 2,631,809 | 3/1953 | Jacobson | 248/317 |
| 2,760,674 | 8/1956 | Karp | 24/259 R X |
| 2,944,781 | 7/1960 | Masters | 248/228 |
| 3,102,614 | 9/1963 | Lydard | 248/72 X |
| 3,131,447 | 5/1964 | Tinnerman | 248/72 UX |
| 3,601,862 | 8/1971 | Hargadon | 248/317 |
| 3,743,228 | 7/1973 | Drab | 24/259 R X |

*Primary Examiner*—J. Franklin Foss
*Attorney, Agent, or Firm*—Baldwin, Egan, Walling & Fetzer

[57] ABSTRACT

A hanger clip is presented formed of a single elongated strip of metal having spring characteristics and adapted to be manually clipped to an overhead beam, such as "T" bar or the like. The strip has a sharp return bend at approximately midway of its length providing two upwardly extending legs lying close to each other to a common level and then being bent outwardly at an obtuse angle, and again being bent inwardly at the end of the first inclined runs at the same acute angle, thus forming clipping runs of approximately equal length and having their terminal ends spaced from each other. The hooks formed by the acute angle bends are spaced apart, when unstressed, by a distance less than the width of the beam to which the clip is intended to be attached.

1 Claim, 12 Drawing Figures

CLIP FOR HANGING SIGNS

This invention relates to a spring clip which is useful for hanging signs from a grid ceiling used in supermarkets, discount stores, drug stores, and the like. The clip is installed by hooking the clip over one edge of a "T" bar and then pushing on the clip to open it up and snap on the other side of the "T" bar.

Previously known fasteners of this type have had disadvantages such as complex construction which renders them expensive to fabricate and difficult to install, or utilizing portions of the clip member which must be bent, connected by screws or the like, to retain them on the supporting beam. Such known hangers have not always provided a reliable connection to the supporting beam and have proven to be unsatisfactory because the clip retainer is not an integral structure.

An object of the present invention, therefore, is to provide an integral hanger clip of simple construction adapted to be attached to a supporting beam with a minimum of manual manipulation and requiring the use of no tools.

Other objects and advantages of the invention will be apparent from the accompanying drawings and description and the essential features thereof will be set forth in the appended claims.

Figure 10:
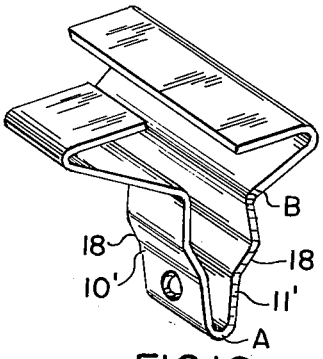
Figure 11:
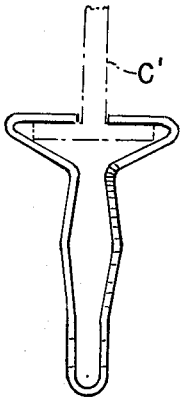
Figure 12:
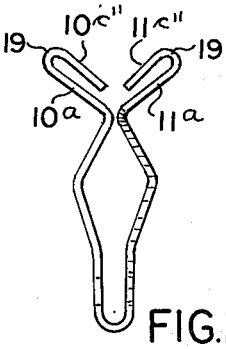

FIGS. 10 and 11 are respectively perspective and end views of another modification wherein the legs extending upwardly from a reverse bend at approximately the middle of the clip blank are bent slightly along a horizontal line outwardly; while FIG. 12 is another modification similar to FIGS. 10 and 11 but wherein the clipping runs are bent backwardly along the prior inclined runs to lie substantially parallel thereto.

Figure 1:
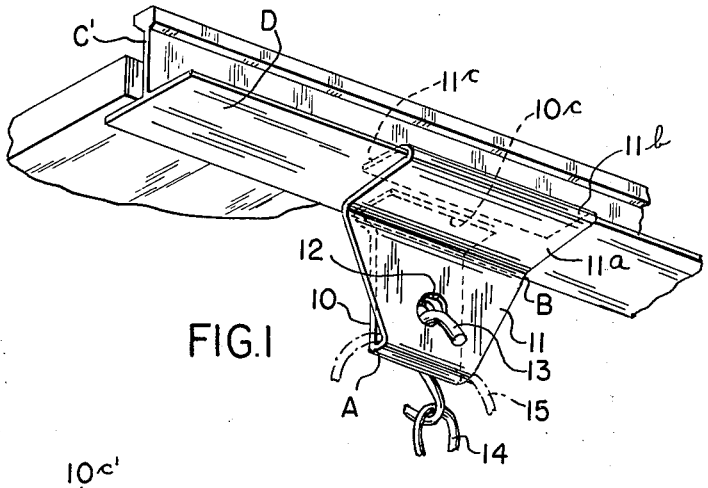
FIG. 1 is a fragmental perspective view showing one of the hanger clips of this invention in position for use mounted on a "T" bar.
Figure 2:
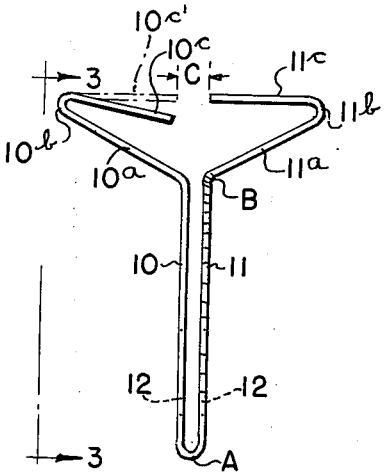
FIG. 2 is an end view of the clip of FIG. 1 taken from the left-hand side thereof.
Figure 3:
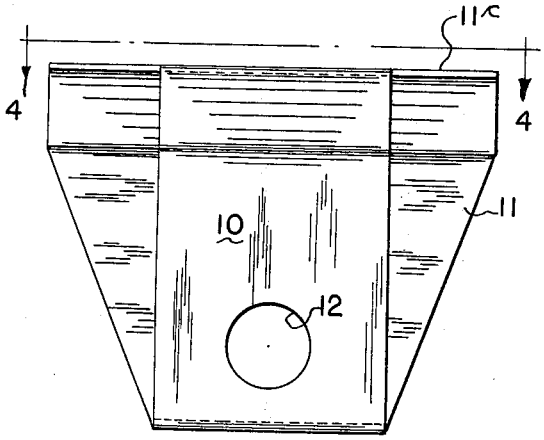
FIG. 3 is a side elevational view of the same taken along the line 3—3 of FIG. 2.
Figure 5:
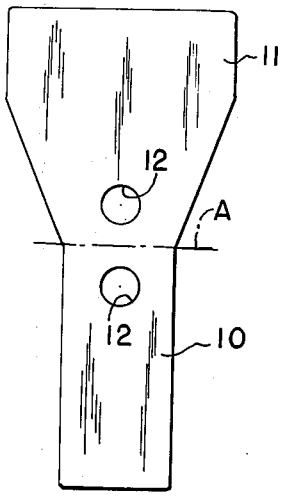
FIG. 5 is a plan view of a metal blank for forming the clip of FIGS. 1 to 4.
Figure 4:
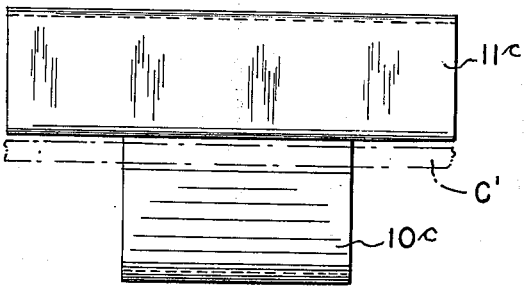
FIG. 4 is a top plan view of the same taken along the line 4—4 of FIG. 3.

The clip of this invention as shown in FIGS. 1 through 5 is formed integrally from a single elongated strip of metal having spring characteristics as shown in plan view in FIG. 5. This strip is bent upwardly at approximately its mid-point as indicated at A in FIGS. 2 and 5 to provide two upwardly extending legs 10 and 11 which extend upwardly close together to a predetermined substantially common level as indicated at B in FIG. 2. These two legs may be parallel as shown in FIG. 2 or they might more preferably diverge slightly as they extend between A and B. At the level B, each leg turns outwardly at an obtuse angle forming inclined runs 10*a* and 11*a*. Preferably, these two runs are approximately equal in length. At their outer ends, each of these legs is then turned inwardly at an acute angle 10*b* or 11*b*, and then each leg extends inwardly and substantially horizontally to form a clipping run as indicated at 10*c* and 11*c*. The distal ends of the clipping runs are spaced apart as shown at C in FIG. 2, this dimension being greater than the vertical leg of the "T" bar as seen at C′ in FIG. 1. In one form of the invention, the clipping run 10c is bent at an angle of approximately 11½° below the horizontal, but the same could be as shown in dotted lines in FIG. 2 at 10*c*′ so that both of the runs 10*c*′ and 11*c* would lie substantially horizontally.

In a preferred form of the invention, each leg of the clip has a through opening 12 spaced equally distant from the sharp return bend at A as indicated at 12 so that these openings are substantially concentric in the two upwardly extending legs 10 and 11 as clearly indicated in FIGS. 1 and 2. This provides an opening to receive a hook end 13 of a member adapted to support a chain 14 carrying a sign or other material. The openings 12 are not essential as a flexible member 15 shown in dot-dash lines in FIG. 1 could be passed just above the reverse bend A to support material beneath the hanger.

Figure 6:
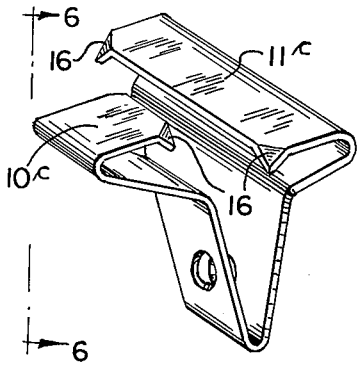
FIGS. 6 and 7 are respectively perspective and elevational views of a modified clip including downwardly inclined sharp end portions of the strip of metal in position to bite into the upper face of the flanges of a supporting overhead beam.
Figure 7:
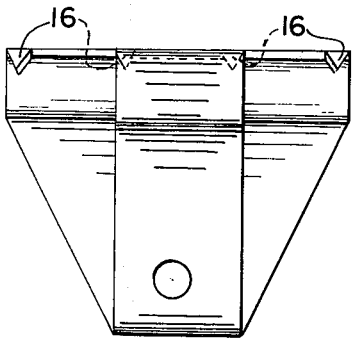

FIGS. 6 and 7 show a modification which in general is like the first embodiment shown in FIGS. 1 through 5 except that inclined corner portions 16 are bent down at the opposite sides of the distal ends of the clipping portions 10*c* and 11*c* to provide sharp edges which will bite into the upper face of the supporting "T" bar shown in FIG. 1 to keep the hanger clip from sliding endwise of the supporting bar when a sign or the like is hung as described in connection with 12, 13 or 15 in FIG. 1.

Figure 8:
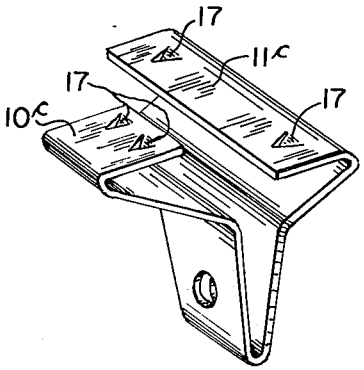
FIGS. 8 and 9 are respectively perspective and end elevational views of another modification showing downwardly inclined sharp portions of the strip of metal struck out of the strip so as to incline downwardly from the clipping runs of the clip so as to bite into the upper face of the flanges of a supporting overhead beam.
Figure 9:
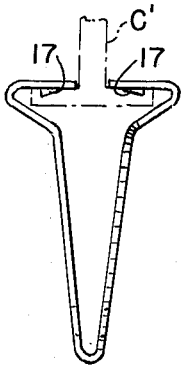

FIGS. 8 and 9 show another modification which is in all respects similar to the form described in FIGS. 1 through 5 except that sharp triangular barbs 17 are sheared out of the strip material in the clipping runs 10*c* and 11*c*, these barbs having pointed ends in position to bite into the upper face of the flanges of the supporting "T" bar such as is shown in FIG. 1.

Another modification is shown in FIGS. 10 and 11 which is like that described in connection with FIGS. 1 through 5 except that the upstanding legs 10′ and 11′ are bent slightly outwardly at 18 along a horizontal line which is preferably, but not necessarily, between 60 and 70 percent of the length upwardly from reverse bend A toward the position B. This shape puts pressure at the top of the clip to prevent it from opening up under the process of heat treating which follows the process of bending. FIG. 11 shows this form of clip mounted in effective position on the bottom flange of the "T" bar as shown in FIG. 1.

FIG. 12 shows another modification which is like that shown and described in FIGS. 10 and 11 but in which the inclined runs 10*a* and 11*a* are provided with sharp bends at 19 causing the clipping runs 10*c*″ and 11*c*″ to lie substantially parallel to the associated inclined runs 10*a* and 11*a*. This form of clip places the hook members 10*a*, 10*c*″ and 11*a*, 11*c*″ in a position to clip over a wider "T" bar flange of a character shown at D in FIG. 1.

One form of this device constructed according to the FIGS. 1 through 5 has an inside dimension between 10*b* and 11*b* of 0.812 inches; and overall height of 1.213 inches; a width of the part 11c equal to 1½ inches and the width of the part 10*c* being ¾ of an inch. This model was made out of 0.015 inch spring steel.

In use of this device, one of the clipping runs is clipped over one of the lateral edges of the bottom flange D of the supporting beam, preferably the member 11*c*, and then the other clipping run 10*c* is snapped over the opposite parallel edge of the bottom flange D often by manipulating the parallel legs 10 and 11 to cause the member 10*c* to snap over the supporting beam.

What is claimed is:

1. A unitary hanger clip, adapted to be manually clipped to an overhead beam having oppositely extending lower horizontal flanges extending a predetermined width, consisting of a single elongated strip of metal having spring characteristics, said strip having a sharp return bend at approximately midway of its length providing two upwardly extending legs; said legs lying close together but spaced apart to a predetermined substantially common level; both of said legs turning outwardly at said level at an obtuse angle forming inclined runs; said runs being of approximately equal length; and thereafter each leg being bent inwardly at approximately the same acute angle forming clipping runs; said clipping runs being of approximately equal length and having their terminal ends spaced from each other; and the space between said acute angle bends being less than said predetermined width of said horizontally extending flanges; whereby when said clip is applied to said horizontal flanges of a beam said spring characteristics of said metal holds said clip tightly to said beam; wherein each of said legs is bent slightly along a horizontal line outwardly and then back inwardly at a level about 60 to 70 percent of the length upwardly from the sharp return bend to the outwardly turning obtuse angle, each of said legs at the end of said inclined runs being bent inwardly, each at an acute angle to cause said clipping runs each to be substantially parallel to its associated inclined run.

* * * * *